US010005643B2

(12) United States Patent
Widmer

(10) Patent No.: US 10,005,643 B2
(45) Date of Patent: Jun. 26, 2018

(54) ELEVATOR SYSTEM

(71) Applicant: Inventio AG, Hergiswil (CH)

(72) Inventor: Heinz Widmer, Rotkreuz (CH)

(73) Assignee: INVENTIO AG, Hergiswil NW (CH)

( * ) Notice: Subject to any disclaimer, the term of this patent is extended or adjusted under 35 U.S.C. 154(b) by 0 days. days.

(21) Appl. No.: 15/532,128

(22) PCT Filed: Dec. 2, 2015

(86) PCT No.: PCT/EP2015/078389
§ 371 (c)(1),
(2) Date: Jun. 1, 2017

(87) PCT Pub. No.: WO2016/087532
PCT Pub. Date: Jun. 9, 2016

(65) Prior Publication Data

US 2017/0267491 A1 Sep. 21, 2017

(30) Foreign Application Priority Data

Dec. 2, 2014 (EP) ..... 14195745

(51) Int. Cl.
*B66B 11/02* (2006.01)
*B66B 1/42* (2006.01)
*B66B 11/00* (2006.01)

(52) U.S. Cl.
CPC ..... *B66B 11/022* (2013.01); *B66B 1/425* (2013.01); *B66B 11/0095* (2013.01)

(58) Field of Classification Search
CPC ... B66B 1/425; B66B 11/0095; B66B 11/022; B66B 11/0213
See application file for complete search history.

(56) References Cited

U.S. PATENT DOCUMENTS 1,911,834 A * 5/1933 Lindquist ..... B66B 9/00 187/249
5,526,901 A * 6/1996 Salmon ..... B66B 11/0095 187/249

(Continued)

FOREIGN PATENT DOCUMENTS

JP H11228058 A 8/1999
JP 2001080856 A 3/2001

(Continued)

*Primary Examiner* — Michael A Riegelman
(74) *Attorney, Agent, or Firm* — William J. Clemens; Shumaker, Loop & Kendric, LLP

(57) ABSTRACT

An elevator system has a car assembly including a first elevator car, a second elevator car, a counterweight, and a drive machine unit having a traction sheave and a traction device guided over the traction sheave. The traction device is connected to the car assembly and the counterweight on opposite side of the traction sheave. An adjustment mechanism enables the second elevator car to be adjusted in relation to the first elevator car within the car assembly. The adjustment mechanism has an adjustment device, a first adjustment traction device and a second adjustment traction device. The first adjustment traction device and the second adjustment traction device are guided over the adjustment device. The first adjustment traction device and the second adjustment traction device are connected to the second elevator car on one side of the adjustment device and to the counterweight on the other side.

13 Claims, 4 Drawing Sheets

(56) References Cited

U.S. PATENT DOCUMENTS 5,584,364 A * 12/1996 Sakita ..... B66B 7/06 187/249
8,087,497 B2 * 1/2012 Fargo ..... B66B 7/068 187/249
2006/0163006 A1 7/2006 Strebel et al.
2006/0191747 A1 * 8/2006 Mustalahti ..... B66B 1/42 187/249
2008/0142308 A1 * 6/2008 Kocher ..... B66B 9/00 187/249
2009/0229923 A1 * 9/2009 Aulanko ..... B66B 11/0045 187/266
2011/0005867 A1 * 1/2011 Kocher ..... B66B 9/00 187/249
2011/0024239 A1 * 2/2011 Kocher ..... B66B 5/027 187/249
2011/0088980 A1 * 4/2011 Husmann ..... B66B 7/10 187/249
2012/0006626 A1 * 1/2012 Adifon ..... B66B 7/08 187/249
2012/0097484 A1 * 4/2012 Cortona ..... B66B 11/022 187/249
2016/0096707 A1 * 4/2016 Banno ..... B66B 11/022 187/247
2016/0244299 A1 * 8/2016 Zerelles ..... B66B 11/022
2016/0251202 A1 * 9/2016 Muller ..... B66B 11/0095 187/249
2016/0311655 A1 * 10/2016 Cortona ..... B66B 11/022
2017/0121152 A1 * 5/2017 Zerelles ..... B66B 11/022
2017/0267488 A1 * 9/2017 Kocher ..... B66B 11/022
2017/0267490 A1 * 9/2017 Haapaniemi ..... B66B 11/0095
2017/0275137 A1 * 9/2017 Jacobs ..... B66B 11/0095

FOREIGN PATENT DOCUMENTS

JP 2001310883 A 11/2001
WO 2005014461 A1 2/2005

* cited by examiner (1) $m = m_1 + m_2$ (2) $m_2 \gg m_1$ (3) $m_{AK} \leq \frac{1}{2} \cdot m$

Fig. 3

ELEVATOR SYSTEM

FIELD

The invention relates to an elevator system having a first elevator car and at least a second elevator car that is preferably arranged in a support frame, in particular in an elevator car support frame of the elevator system. Specifically, the invention relates to the area of the elevator systems, which are designed as so-called double-deck elevator systems.

BACKGROUND

An elevator having two elevator cars is known from WO 2005/014461 A1, the two elevator cars being coupled to each other in such a way that they can be moved together in an elevator shaft. A vertical separation between the two elevator cars can be adjusted by moving at least one elevator car in relation to the other elevator car. An adjustment cable serves to do this. One end of the adjustment cable is attached at the end to the shaft floor. A counterweight hangs from the other end. In addition, the adjustment cable is guided via a traction sheave of an adjustment drive that includes an elevator machine. An additional elevator machine is also provided that serves to move the whole assembly, including both elevator cars, through the elevator shaft.

The elevator system known from WO 2005/014461 A1 has the disadvantage that it broadly requires two complete assemblies having elevator machinery and counterweights as well as the required deflection rollers in order to realize the joint motion of both elevator cars through the elevator shaft as well as the adjusting mechanisms of both elevator cars to each other. Powerful elevator machinery is also required here because, for example, the complete load of the assembly must be moved through the elevator shaft just by the additional elevator machine. In addition to the high expense for the large number of powerful components, they also result in a larger space requirement and higher construction expenditures in the realization.

In the realization of a custom adjustment mechanism for adjusting the two elevator cars to one another, it is conceivable that the components for these adjustment mechanisms are mounted on the elevator car frames. This design has the disadvantage, however, that the drive for the adjusting mechanism, in particular, can also be mounted on the elevator car frame and the elevator machine that is required to move the assembly of elevator cars in addition to the adjustment mechanism must be designed to be more effective. The mass of the counterweight needed for this is also greater.

JP H11228057 and JP 2001080856 also describe elevators having two elevator cars in one car assembly that are adjustable relative to one another. The corresponding adjustment mechanisms have two adjustment traction means that are connected to an elevator car on one side and to a counterweight on the other.

SUMMARY

It is an object of the invention to create an elevator system that has an improved design. Specifically, it is an object of the invention to create an elevator system, in which the adjustment of a plurality of elevator cars to one another in an optimized manner is made possible and/or in which the demand on a drive machine unit for joint movement of the elevator cars through an elevator shaft is reduced.

Solutions and proposals for a corresponding elevator system are hereinafter presented that solve that at least parts of at least one of the objects. In addition, advantageous supplemental or alternative further developments and embodiments are specified.

The elevator system includes a car assembly having a first elevator car and having at least a second car, a counterweight and a drive machine unit having a traction sheave and a traction means. The traction means is guided over the traction sheave of the drive machine unit, the traction means being connected to the car assembly on one side of the traction sheave and to the counterweight on the other. In addition, the car assembly is movable in a travel space provided in an elevator shaft for the joint travel of the elevator cars of the car assembly. An adjustment mechanism is also provided by which the second elevator car is adjustable relative to the second elevator car within the car assembly. The elevator system is characterized in that the adjustment mechanism of an adjustment device has a first adjustment traction means and a second adjustment traction means, that the first adjustment traction means and the second adjustment traction means are guided through the adjustment device and that the first adjustment traction means and the second adjustment traction means are connected to the second elevator car on one side of the adjustment device and to the counterweight on the other side of the adjustment device.

The elevator system includes a first elevator car and a second elevator car. Further elevator cars could also be provided. At least the second elevator car is adjustable relative to the first elevator car and to the traction means. If a support frame, in particular an elevator car support frame, is provided, the second elevator car is then adjustable with respect to such a support frame, while the first elevator car is arranged in an at least substantially stationary manner in the support frame. It is understood that appropriate damping means or the like, in particular a spring suspension device, can be provided.

The term traction means and the term adjustment traction means are to be taken generally in this context. Single and multi-stranded embodiments are possible. In multi-stranded embodiments, separate assemblies of the individual strands can also be realized. Partially separated and partially combined designs can also be realized. In addition, support as well as traction means can also be realized together in one strand or separated in a plurality of strands. For the traction means, an appropriate frictional contact to the support means of the drive machine unit is realized.

The term elevator shaft is to be taken generally in this context. If necessary, dividing elements can also be provided by the building or separately in order to divide the travel space, for example, from the counterweight space. In addition, a certain spatial division between the travel space and a space for the adjustment device can also be provided in this manner. Correspondingly, the drive machine unit can also be housed in a separate machine room or not separated in the elevator shaft.

Joint travel of the elevator cars of the car assembly through the travel space elevator cabins is to be understood as, in particular, a joint lifting or lowering. An inclined elevator design is, however, also conceivable.

In addition, depending upon the design of the elevator system, the adjustment of the second elevator car relative to a stationary first elevator car and/or during joint travel of the elevator cars through the travel space of the elevator shaft can be possible.

According to the invention, the adjustment device is suspended via the first adjustment traction means and the second adjustment traction means in the elevator shaft. An appropriate guide can be provided for the adjustment device using guide rails that are placed in the elevator shaft. A support for the adjustment device that absorbs the weight of the adjustment device is then not required. It is also advantageous if the first adjustment traction means engages with the second elevator car in such a manner that the pulling force transferred from the first adjustment traction means to the second elevator car works against gravity. It is also possible that the car assembly advantageously has a support frame, that at least one deflection roller is mounted on the support frame and that the first adjustment traction means coming from the adjustment device is guided by at least one deflection roller back down to the second elevator car. Within the support frame, an appropriate guide for the second elevator can be realized, for example, on the support frame. The pulling force transferred to the second elevator car does not necessarily work vertically against gravity. In some cases, also just one force component of the pulling force may work against gravity.

It is further advantageous if the second adjustment traction means engages with the second elevator car in such a way that the pulling force transferred from the second adjustment traction means to the second elevator car works in the direction of gravity. This pulling force transferred to the second elevator car does not necessarily work in the direction of gravity. In some cases, a single force component of this pulling force can work in the direction of gravity. Preferably, the pulling force transferred from the second adjustment traction means to the second elevator car, however, works at least essentially in the direction of gravity so that this pulling force leads to a maximum possible load with gravity. It is thus advantageous that the pulling force transferred from the first adjustment traction means to the second elevator car works at least partially against the direction of gravity, while the pulling force transferred from the second adjustment traction means to the second elevator car at least partially works in the direction of gravity. A design is preferably thus realized wherein the pulling force transferred from the first adjustment traction means to the second elevator car essentially works at least partially against the direction of gravity and/or wherein the pulling force transferred from the second adjustment traction means to the second elevator car essentially works at least partially in the direction of gravity.

It is advantageous if the adjustment device has a first roller set around which the adjustment first traction means is guided in such a manner that the adjustment traction means is at least partially suspended via the first adjustment traction means in the elevator shaft. It is additionally advantageous if the adjustment device has a second roller set around which the second adjustment traction means is guided in such a manner that the adjustment device is at least partially suspended via the second adjustment traction means in the elevator shaft. The adjustment device advantageously has an adjustment device, by which a distance between the first roller set and the second roller set can be adjusted. An adjustment of the distance between the roller sets thus effects a corresponding actuation of the two elevator cars within the car assembly. This results in a relative adjustment of the second elevator car to the first elevator car.

Depending upon the design, the adjustment unit between the first roller set and the second roller set can by loaded by tension alone, or by tension and compression. For example, the adjustment unit can be designed as a block and tackle that can only be loaded by tension. With loading by tension and compression, the adjustment unit can be designed specifically as a spindle unit or as an electrohydraulic adjustment unit. However, also in the case of a design as a spindle unit or as an electrohydraulic adjustment unit, a design can also be realized regarding a load provided for tension alone.

In an advantageous manner, the adjustment device has an adjusting drive for the adjustment unit. In an advantageous embodiment, such an adjusting drive is suspended via the two roller sets in the elevator shaft. This is specifically appropriate in an embodiment in which the adjustment unit between the first roller set and the second roller set is only loadable by tension. This is because only the weight of the first roller set must be additionally compensated for. In some cases, an additional weight can also be provided on the first roller set.

It is advantageous in the design of the elevator system that an adjustable mass of the second elevator car is no greater than half the mass of the adjustment device. This ensures that the movable second elevator car in its lowest position does not operate within the car assembly.

DESCRIPTION OF THE DRAWINGS

Preferred exemplary embodiments of the invention are explained in more detail in the description below in reference to the attached drawings, in which corresponding elements are denoted by the same reference numbers, and to the attached formulas. Shown are:

FIG. 3 shows the specifications for a permissible weight distribution in the adjustment device or between the adjustment device and an elevator car based on formulas (1), (2) and (3).

DETAILED DESCRIPTION

Figure 1A:
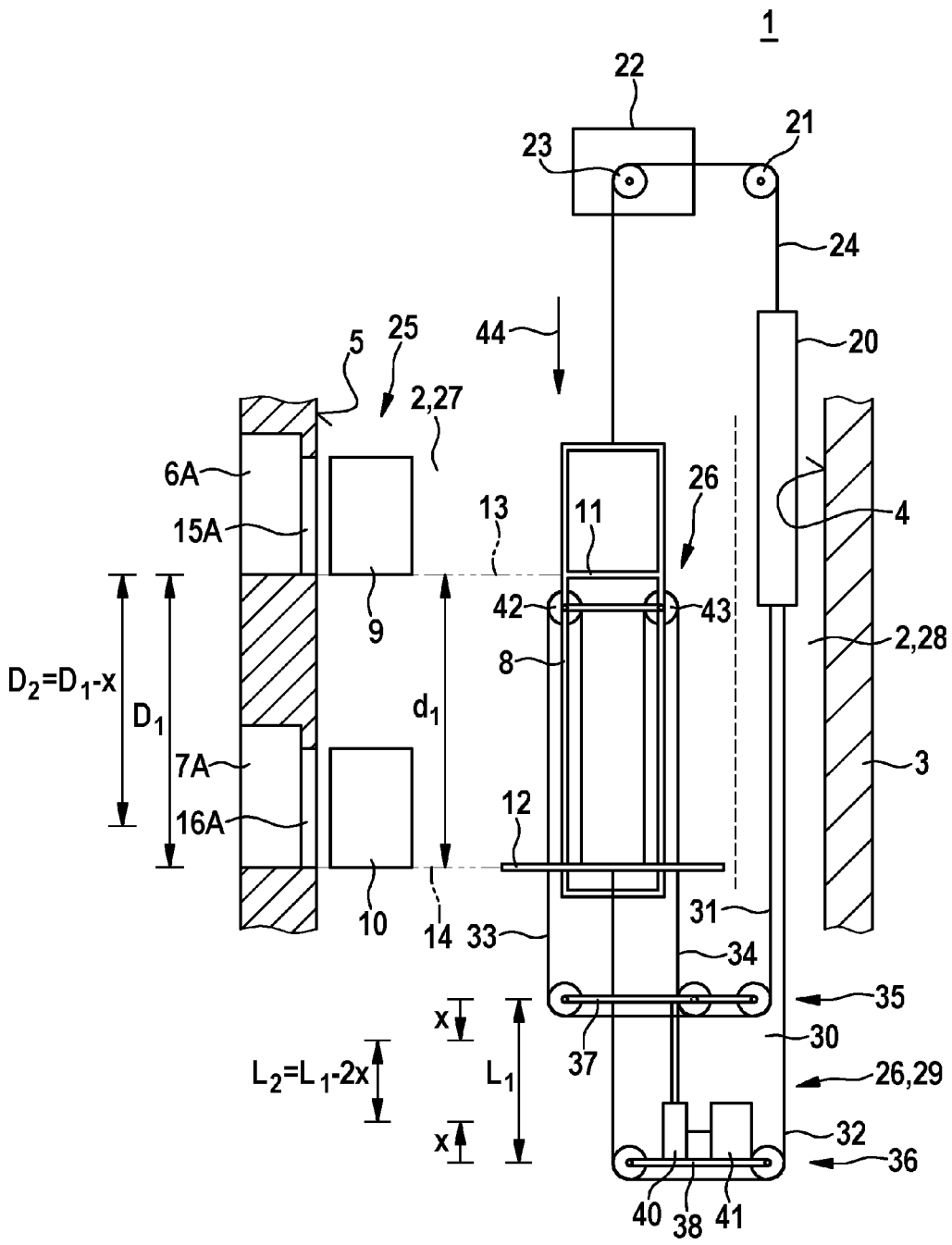
FIG. 1A shows an elevator system having an exemplary first car configuration in a partial, schematic illustration corresponding to an exemplary embodiment of the invention.

FIG. 1A shows an elevator system 1 in an elevator shaft 2 of a building 3 in a partial, schematic illustration corresponding to an exemplary embodiment of the invention. The following introduced variables d, D and L are used here as variables that each take the concrete values d1 and d2, D1 and D2 as well as L1 and L2 in the description of the exemplary embodiment. These concrete values d1, d2, D1, D2, L1 and L2 are plotted in FIGS. 1A and 1B as possible values for variables d, D and L.

As illustrated in FIG. 1A, elevator shaft 2 is delimited by shaft walls 4, 5, of building 3. Also shown are adjacent floors 6A, 7A of building 3. Between these floors 6A, 7A and any other floors, in particular floors 6B and 7B (FIG. 1B), a distance D is variable. Floors 6A, 7A have a distance D1 from each other. Variable distance D is in this exemplary embodiment a vertical distance D.

Elevator system 1 has a support frame 8. Support frame 8 can be designed as elevator car frame 8, in which a first elevator car 9 and a second elevator car 10 can be arranged.

In this exemplary embodiment, first elevator car 9 is mounted on a support 11 of support frame 8. Second elevator car 10 is mounted on a platform 12 of support frame 8. Platform 12 is thus movable relative to support 11.

For simplification and greater clarity of the illustration, elevator cars 9, 10 in the illustration from FIG. 1 are depicted, along with support frame 8, from the side. The vertical position of elevator cars 9, 10 with respect to support 11 or platform 12 is clarified using guidelines 13, 14.

An exemplary car configuration of elevator cars 9, 10 within the support frame is characterized by the adjustment of distance d between elevator cars 9, 10 to a value d1. Value d1 is specified for floors 6A, 7A using concrete distance D1.

In this exemplary embodiment, first elevator car 9 is positioned at the height of a shaft door 15A of floor 6A. Second elevator car 10, is positioned at the height of a shaft door 16A of floor 7A. Distance d, set to value d1 between elevator cars 9, 10, is thus initially equal to distance D1 between floors 6A, 7A. Distance d is also a vertical distance in this exemplary example.

Elevator system 1 also has a counterweight 20, a roller set 21 arranged at the top of elevator shaft 2 and a drive machine unit 22 having a traction sheave 23. In addition, a traction means or device 24 is provided that is connected to support frame 8, for example to support 11, on one side of traction sheave 23 and to counterweight 20 on the other side of traction sheave 23. Traction means 24 and roller set 21 here run over traction sheave 23. Using support frame 8, a car assembly 25 of elevator cars 9, 10 is possible. Traction means 24 is also connected at least indirectly on one side of traction sheave 23 to first elevator car 9 via support 11. In this manner, first elevator car 9 is arranged fixed relative to traction means 24. By contrast, using movable platform 12, second elevator car 10 is movably arranged within car assembly 25 with respect to traction means 24.

The term traction means 24 is to be understood generally. For example, traction means 24 can also be formed from a plurality of strands that are preferably guided together over traction sheave 23 and roller set 21. Traction means 24 then also assumes the support function. Modifications are also conceivable, however.

Elevator system 1 also has an adjustment mechanism 26. First elevator car 9 and second elevator car 10 are adjustable relative to one another within car assembly 25 via adjustment mechanism 26. The adjustment mechanism allows an adjustment of distance d between first elevator car 9 and second elevator car 10. For example, traction means 24 can stop if traction sheave 23 of drive machine unit 22 is not rotating. Then a situation in which first elevator car 9 and traction means 24 remain stationary in elevator shaft 2 arises. Adjustment mechanism 26 then allows a movement of second elevator car 10 in elevator shaft 2. Depending upon the design and the control possibilities for elevator system 1, such an adjustment can also take place when traction sheave 23 and, thus, traction means 24, is moving.

Elevator shaft 2 is divided in this exemplary embodiment into a travel space 27 and a counterweight space 28. Travel space 27 serves here for joint travel of elevator cars 9, 10 of car assembly 25 within elevator shaft 2. Counterweight space 28 is available for the travel or movement of counterweight 20 within elevator shaft 2.

Adjustment mechanism 26 has an adjustment device 29. Adjustment device 29 is housed in a space 30 of elevator shaft 2 that is reserved for adjustment device 29.

Adjustment mechanism 26 has a first adjustment traction means or device 31 and a second adjustment traction means or device 32. Adjustment traction means 31, 32 can also be designed as multiple strands. For example, in this exemplary embodiment, strands 33, 34 of first adjustment traction means 31 are run through elevator shaft 2 partially together and partially separated from each other. First adjustment traction means 31 is guided over a first roller set 35. Second adjustment traction means 32 is guided over a second roller set 36. Roller sets 35, 36 are parts of adjustment device 29. First roller set 35 is attached to a first support 37 of adjustment device 29 in this exemplary embodiment. Second roller set 36, for example, is attached to a second support 38 of adjustment device 29.

In addition, adjustment mechanism 29 has an adjustment unit 40 and an adjusting drive 41 for adjustment unit 40. A distance L between roller sets 35, 36 can be adjusted via adjustment unit 40. Depending upon the embodiment, adjustment unit 40 can be loaded by tension and additionally with compression if necessary.

Deflection rollers 42, 43 are mounted on support frame 8. Strands 33, 34 of first adjustment traction means 31 are guided from adjustment device 29 up around deflection rollers 42, 43 and back down to platform 12. In this manner, strands 33, 34 of first adjustment traction means 31 are guided on one side to second elevator car 10, which is arranged or mounted on movable platform 12. In addition, second adjustment traction means 32 is connected on one side to platform 12 and thus to second elevator car 10. On the other side, first adjustment traction means 31 and second traction means 32 are connected to counterweight 20.

Gravity 44 or the direction of gravitational acceleration 44 is shown in FIG. 1 by an arrow 44. First adjustment traction means 31 engages with second elevator car 10 in such a manner that the pulling force transferred from first adjustment traction means 31 to second elevator car 10 works against direction 44 of gravity. Second adjustment traction means 32 engages with second elevator car 10 in such a manner that the pulling force transferred from second adjustment traction means 32 to the second elevator car 10 works in direction 44 of gravity.

First adjustment traction means 31 is guided around first roller set 35 in such a manner that adjustment device 29 is at least partially suspended via first adjustment traction means 31 in elevator shaft 2. Specifically if adjustment unit 40 can only be loaded by tension, the part of adjustment device 29 mounted on first support 37 is suspended via first adjustment traction means 31 in elevator shaft 2.

Second adjustment traction means 32 is guided around second roller set 36 in such a manner that adjustment device 29 is at least partially then suspended via second adjustment traction means 32 in the elevator shaft. Specifically, if adjustment unit 40 can only be loaded by tension, the part of adjustment device 29 mounted on second support 38 is then suspended via second adjustment traction means 32 in elevator shaft 2.

In this exemplary embodiment, adjusting drive 41 is arranged mounted on second support 38 of adjustment device 29.

In operating elevator system 1, an adjustment of distance d between elevator cars 9, 10 is possible. For example, a larger ceiling height in the area of an entry hall can be provided that causes a larger distance D if second elevator car 10 stops at the entry hall while first elevator car 9 stops at the floor above. In addition, an air conditioning system, for example, can be housed between two floors, so that distance D between these floors is increased.

Figure 1B:
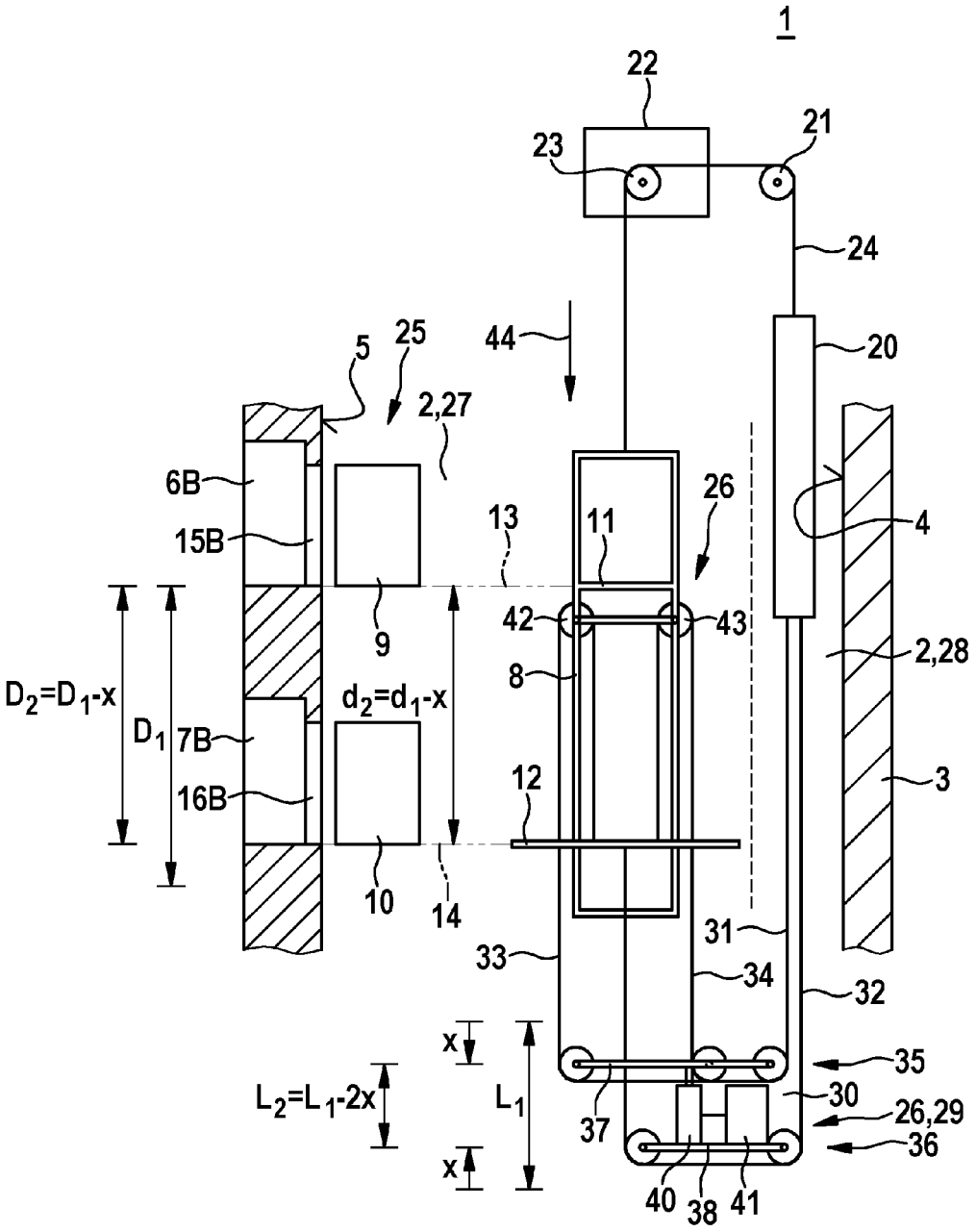
FIG. 1B shows the elevator system having an exemplary second car configuration in a partial, schematic illustration corresponding to an exemplary embodiment of the invention.

With respect to the further elaboration of the invention, FIG. 1B shows elevator system 1 having an exemplary second car configuration of elevator cars 9, 10 in a partial, schematic illustration corresponding to the exemplary embodiment of the invention. Two additional floors 6B, 7B are illustrated that have distance D2 from one another. Distance D2 is smaller in this example than distance D1.

In the following, it is described how an adaptation to a smaller distance D2 is possible, based on a specified distance D1. This is to illustrate the introduction of an auxiliary variable x, where D2=D1−x. By activating adjusting drive 41, adjustment unit 40 is operated in such a way that between roller sets 35, 36 distance L, which in FIG. 1A has the initial value L1, is reduced. This displaces roller set 35 downwards in this exemplary example relative to elevator shaft 2 by a distance of x. This gives a correspondingly large displacement of second roller set 36 upwards by a distance of x.

Variable distance L between roller sets 35, 36 is thus shortened from its initial value L1 (FIG. 1A) by a distance of L2=L1−2x, as is shown in FIG. 1B. In this example, variable distance d is shortened from specific distance d1 to specific distance d2=d1−x.

Conversely, adjusting drive 41 can also be activated so that first roller set 35 rises and second roller set 36 drops. As a result, distance L1 indicated in the initial state can be again assumed.

It should be noted that different versions of distance L of roller sets 35, 36 to one another can be realized in order to allow for a corresponding number of appropriate, specific values for distance d between elevator cars 9, 10. Regarding values D1, D2, . . . for floor distance D derived from the building, target values d1, d2, are directly derived for distance d of elevator cars 9, 10 and, from them, target values L1, L2, . . . for distance L between roller sets 35, 36.

The design of elevator system 1, in particular of adjustment device 29 of adjustment mechanism 26, is further described below in reference to FIG. 2 and to the accompanying formulas (1), (2) and (3) of FIG. 3.

Figure 2:
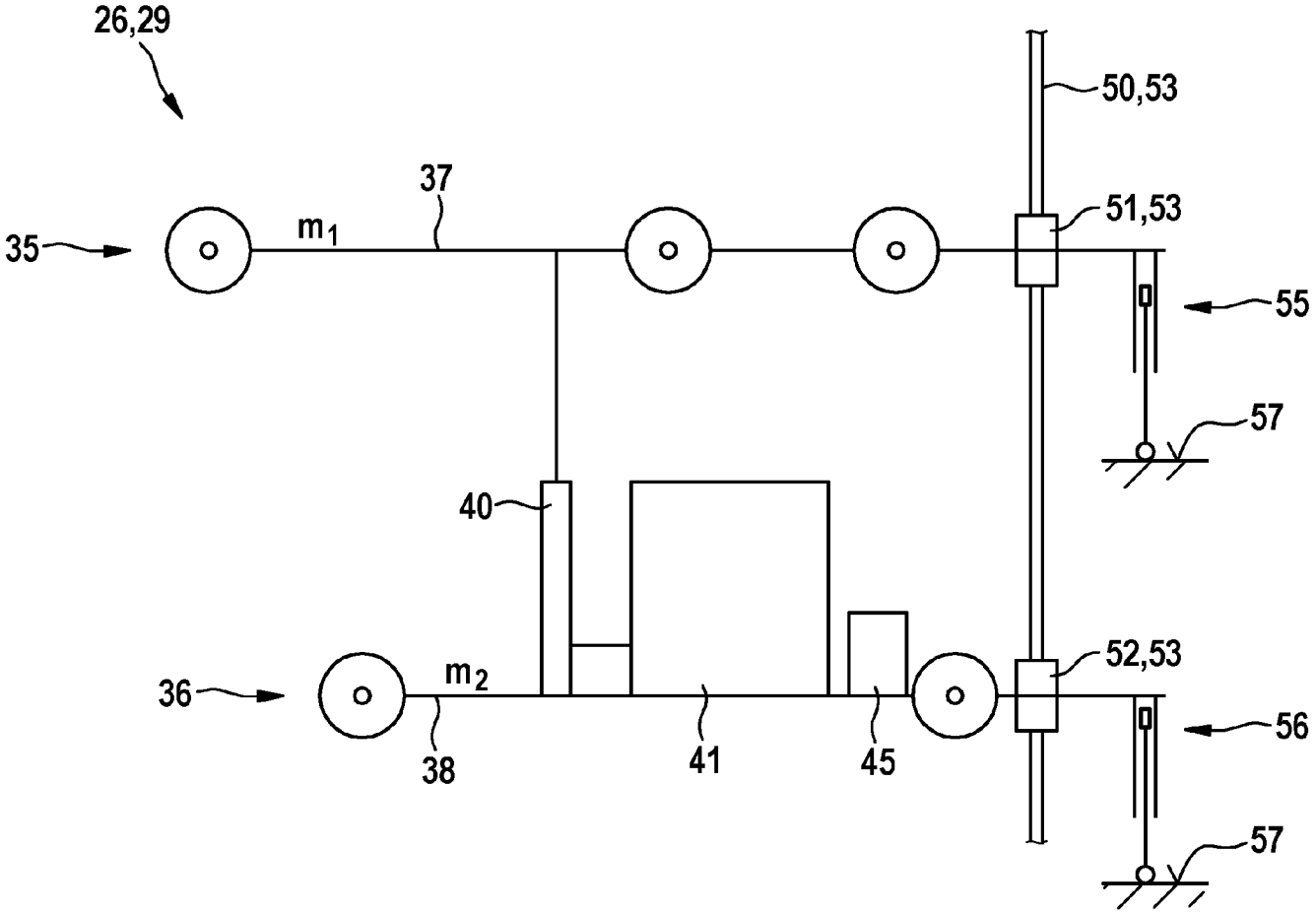
FIG. 2 shows an adjustment device of the elevator system illustrated in FIG. 1A and FIG. 1B in a partial, schematic illustration corresponding to an exemplary embodiment of the invention.

FIG. 2 shows adjustment device 29 of elevator system 1 illustrated in FIG. 1A in a partial, schematic illustration corresponding to the exemplary embodiment of the invention. A mass m1 occurs on first support 37. A mass m2 occurs on second support 38. The total mass of adjustment device 29 is adjusted according to formula (1) from mass m1 on first support 37 and mass m2 on second support 38 combined. Mass m of adjustment device 29 is suspended via adjustment traction means 31, 32 in elevator shaft 2.

Substantial and heavy components of adjustment mechanism 26, in particular of adjusting drive 41 are thus located in a suspended position in elevator shaft 2. When operating elevator system 1, the mass on support frame 11 that must be moved by drive machine unit 22 is thus reduced in comparison to a conceivable embodiment, in which, among others, an adjusting drive 41 is integrated into car assembly 25 or support frame 8.

If adjustment unit 40 is only loaded by tension or, at least, is essentially loaded only by tension, an arrangement of adjusting drive 41 on support 38 is then especially advantageous. This is because according to formula (2) mass m2 on second support 38 can consequently be much larger than mass m1 on first support 37. Mass m1, in particular the mass of first roller set 35, can be compensated for with regards to its own weight. This is because the weight of mass m1 on first support 37 operates over first adjustment traction means 31 as a relieving pulling force on second car 10 and, in the case of an unfavorable weight relationship between masses m1 and m2, could unweight adjusting traction means 32 over elevator car 10 to such an extent that this is no longer loaded by tension or tightly tensioned.

In the case of an adjustment unit 40 loaded only by tension, this can result in an approximately 20% larger requirement of total mass m in contrast to an embodiment in which adjustment unit 40 is loaded by tension and compression in order to reliably permit this compensation.

An adjustment unit 40 loaded only by tension can be designed, in particular, as a block and tackle 40.

Adjustment unit 40 can also be designed in a modified embodiment as a spindle unit 40 or as an electrohydraulic adjustment unit 40. In particular, adjustment units 40 can be realized that can be loaded by tension and compression between roller sets 35, 36.

Independent of the specific embodiment of adjustment unit 40, an adjustable mass mAK of second elevator car 10 cannot be specified as larger than half of the mass of adjustment device 29, as described in formula (3). The adjustable mass mAK thus defined represents one of a potential plurality of restrictions for a permissible total mass or permissible total weight of second elevator car 10. Depending upon the design of elevator system 1, however, the permissible total mass or permissible total weight for second elevator car 10 can also be lower than the upper limit m/2 for the adjustable mass mAK of second elevator car 10 as defined according to formula (3).

Because of the condition according to formula (3), it is ensured that movable second elevator car 10 does not run into its lowest position within car assembly 25, and the entire adjustment device 29 is lifted.

In order to increase mass m of adjustment device 29 and, specifically, mass m2 on second support 38, an additional weight 45 can be provided. Such an additional weight 45 is then preferably arranged on second support 38 so that it is fully incorporated into mass m2. However, a distribution of additional weight 45 on carriers 37, 38 is also conceivable.

Depending upon the design, elevator system 1 can additionally have a brake rail 50, which extends vertically through elevator shaft 2 at least in the area of adjustment device 29. In this embodiment, adjustment device 29 has at least one catch brake 51, 52, which works together with brake rail 50. Brake rail 50 and the at least one catch brake 51, 52 are components of an anti-jump device 53. Anti-jump device 53 prevents adjustment device 29 from springing upwards from its suspended position during unfavorable operating conditions, in particular during malfunctions.

In some cases, safety brake 52 can also be avoided. This is because, in addition to a possible limitation via adjustment device 40, the jump height of the assembly on second support 38 resulting from the caught assembly hitting against support 37 is conceivable. The jump height is limited by second support 38, which can suffice with respect to the specific application.

In addition, depending upon the embodiment of elevator system 1, one or a plurality of damping elements 55, 56 can be provided. Roller sets 35, 36 can be damped by these. Specifically, damping compared to a schematically illustrated shaft floor 57 is possible. Such a damping is specifically advantageous in acceleration processes, in which the car assembly is positively accelerated or slowed in its trip through travel space 27.

One or more advantages can thus be achieved. The mass of car assembly 25 can be reduced, thereby reducing the requirements on drive machine unit 22. In addition, adjusting drive 41 can be removed and arranged uncoupled from elevator cars 9, 10. As with the weight reduction, this leads to an improvement in noise behavior and increases travel comfort. Adjustment device 29 is then located essentially stationary in elevator shaft 2, greatly improving the energy supply.

Furthermore, car assembly 25 can more easily be realized. This reduces the load on support frame 8.

The invention is not limited to the described exemplary embodiments and modifications.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having a car assembly that includes a first elevator car, at least a second elevator car, a counterweight, and a drive machine unit having a traction sheave and a traction means, the traction means being guided over the traction sheave of the drive machine unit, the traction means on one side of the traction sheave being connected to the car assembly and on another side of the traction sheave being connected to the counterweight, the car assembly being movable in a travel space of an elevator shaft provided for joint travel of the elevator cars of the car assembly and an adjustment mechanism by which the second elevator car can be adjusted relative to the first elevator car within the car assembly, comprising:

the adjustment mechanism having an adjustment device, a first adjustment traction means and a second adjustment traction means;

the first adjustment traction means and the second adjustment traction means being guided over the adjustment device and the first adjustment traction means and the second adjustment traction means being connected on one side of the adjustment device to the second elevator car and being connected on another side of the adjustment device to the counterweight; and the adjustment device being suspended via the first adjustment traction means and the second adjustment traction means in the elevator shaft.

2. The elevator system according to claim 1 wherein the first adjustment traction means engages with the second elevator car to transfer a pulling force from the first adjustment traction means to the second elevator car at least partially working against a direction of gravity.

3. The elevator system according to claim 1 wherein the car assembly has a support frame, at least one deflection roller is mounted on the support frame and the first adjustment traction means is guided over the at least one deflection roller between the adjustment device and the second elevator car.

4. The elevator system according to claim 1 wherein the second adjustment traction means engages with the second elevator car to transfer a pulling force from the second adjustment traction means to the second elevator car at least partially working in a direction of gravity.

5. The elevator system according to claim 1 wherein the adjustment device has a first roller set around which the first adjustment traction means is guided such that the adjustment device is at least partially suspended via the first adjustment traction means in the elevator shaft.

6. The elevator system according to claim 5 wherein the adjustment device has a second roller set around which the second adjustment traction means is guided such that the adjustment device is at least partially suspended via the second adjustment traction means in the elevator shaft.

7. The elevator system according to claim 6 wherein the adjustment device has an adjustment unit for adjusting a distance between the first roller set and the second roller set.

8. The elevator system according to claim 7 wherein the adjustment device has an adjusting drive for the adjustment unit and the adjusting drive is suspended via the second roller set in the elevator shaft.

9. The elevator system according to claim 7 wherein the adjustment unit between the first roller set and the second roller set can be loaded only by tension.

10. The elevator system according to claim 9 wherein the adjustment unit is a block and tackle.

11. The elevator system according to claim 7 where in the adjustment unit between the first roller set and the second roller set can be loaded by tension and compression.

12. The elevator system according to claim 11 wherein the adjustment unit is a spindle unit or an electrohydraulic adjustment unit.

13. The elevator system according to claim 1 wherein an adjustable mass of the second elevator car is not greater than half of a mass of the adjustment device.

* * * * *